US011339783B2

(12) United States Patent
Rong et al.

(10) Patent No.: US 11,339,783 B2
(45) Date of Patent: May 24, 2022

(54) PUMP HOUSING STRUCTURE OF THREE-AXIS MULTI-STAGE ROOTS PUMP

(71) Applicant: OVG VACUUM TECHNOLOGY (SHANGHAI) CO., LTD., Shanghai (CN)

(72) Inventors: Yi Rong, Shanghai (CN); Yue Li, Shanghai (CN); Miaole Shen, Shanghai (CN)

(73) Assignee: OVG VACUUM TECHNOLOGY (SHANGHAI) CO., LTD., Shanghai (CN)

( * ) Notice: Subject to any disclaimer, the term of this patent is extended or adjusted under 35 U.S.C. 154(b) by 107 days.

(21) Appl. No.: 16/706,693

(22) Filed: Dec. 7, 2019

(65) Prior Publication Data

US 2021/0088046 A1 Mar. 25, 2021

(30) Foreign Application Priority Data

Sep. 23, 2019 (CN) ..... 201910899996.7

(51) Int. Cl.
*F04C 11/00* (2006.01)
*F04C 2/06* (2006.01)
(Continued)

(52) U.S. Cl.
CPC ..... *F04C 11/001* (2013.01); *F04C 2/06* (2013.01); *F04C 29/04* (2013.01); *F04C 29/12* (2013.01)

(58) Field of Classification Search
CPC ..... F04C 11/001; F04C 2/06; F04C 15/0003; F04C 18/126; F04C 18/14; F04C 29/00;
(Continued)

(56) References Cited

U.S. PATENT DOCUMENTS 2,097,881 A * 11/1937 Hopkins ..... F01C 1/24 418/183
2,694,978 A 11/1954 Berry
(Continued)

FOREIGN PATENT DOCUMENTS

CN 2667203 Y 12/2004 ..... F04C 18/08
CN 201396281 Y 2/2010 ..... F04C 18/14
(Continued)

OTHER PUBLICATIONS

Machine translation CN-107420306 (Year: 2021).*

*Primary Examiner* — Audrey B. Walter
*Assistant Examiner* — Dapinder Singh
(74) *Attorney, Agent, or Firm* — Renner, Kenner, Greive, Bobak, Taylor & Weber

(57) ABSTRACT

A pump housing structure of a three-axis multi-stage Roots pump is provided, comprising a first-stage pump housing, a second-stage pump housing and a third-stage pump housing, wherein the first-stage pump housing is provided with a first center axial hole, a first left axial hole and a first right axial hole; a fixed bearing end cover is mounted on the side of the first-stage pump housing, three fixed bearing chambers are provided on the surface of the fixed bearing end cover; the second-stage pump housing is provided with a second center axial hole, a second left axial hole and a second right axial hole, the third-stage pump housing is provided with a third center axial hole, a third left axial hole and a third right axial hole, and the end surface at the outer side of the third-stage pump housing is fixedly mounted with a non-driving end bearing end cover. The present invention can accommodate and fix three axes through three fixed bearing chambers, respectively. Moreover, since the sum of the axial lengths of the second-stage pump housing and the third-stage pump housing is equal to the axial length of the first-stage pump housing, it not only can strengthen the center stiffness of the
(Continued)

three axes of the Roots pump, but also can ensure that the total axial expansion is evenly divided, reducing the cumulated amount of thermal expansion at the end of the axis.

9 Claims, 13 Drawing Sheets

(51) Int. Cl.
*F04C 29/04* (2006.01)
*F04C 29/12* (2006.01)

(58) Field of Classification Search
CPC ..... F04C 29/04; F04C 29/12; F04C 23/001; F04C 2240/30; F04C 2240/50
See application file for complete search history.

(56) References Cited

U.S. PATENT DOCUMENTS

| | | | | |
|---|---|---|---|---|
| 4,022,553 | A | 5/1977 | Poole et al. | 418/183 |
| 4,595,349 | A | 6/1986 | Preston et al. | 418/206 |
| 4,995,796 | A | 2/1991 | Kambe et al. | 418/9 |
| 5,090,879 | A | 2/1992 | Weinbrecht | 418/9 |
| 5,271,364 | A * | 12/1993 | Snyder | F01C 1/28 123/241 |
| 5,335,640 | A | 8/1994 | Feuling | 123/559.1 |
| 6,699,023 | B2 * | 3/2004 | Naito | F04C 23/001 418/9 |
| 6,776,586 | B2 * | 8/2004 | Naito | F04C 18/126 417/199.1 |
| 7,255,541 | B2 | 8/2007 | Kuramoto et al. | 417/410.3 |
| 7,748,970 | B2 * | 7/2010 | Park | F04C 18/126 418/205 |
| 8,082,784 | B2 | 12/2011 | Grzeslo | 73/261 |
| 8,215,937 | B2 | 7/2012 | Inagaki et al. | 418/206.7 |
| 8,292,597 | B2 * | 10/2012 | Rago | F04C 14/08 417/247 |
| 8,308,458 | B2 | 11/2012 | Kettlewell et al. | 418/19 |
| 8,500,422 | B2 | 8/2013 | Dowdeswell et al. | 418/9 |
| 8,579,601 | B2 | 11/2013 | Kim | 417/251 |
| 8,702,407 | B2 * | 4/2014 | Schofield | F04C 18/126 418/9 |
| 9,062,675 | B2 | 6/2015 | Dixon et al. | F04C 15/0015 |
| 9,080,571 | B2 | 6/2015 | Downham et al. | F04C 29/04 |
| 9,745,978 | B2 | 8/2017 | Kobus et al. | F04C 15/0096 |
| 10,006,360 | B2 * | 6/2018 | Schmidt | F01D 1/34 |
| 10,738,778 | B2 | 8/2020 | Hirano et al. | F04C 18/126 |
| 2003/0133817 | A1 * | 7/2003 | Naito | F04C 27/005 418/9 |
| 2005/0069440 | A1 | 3/2005 | Naito | 418/9 |
| 2006/0222506 | A1 | 10/2006 | Rival | 417/2 |
| 2010/0135839 | A1 | 6/2010 | Fraser | 418/197 |
| 2017/0298733 | A1 | 10/2017 | Williams et al. | F01C 1/126 |
| 2019/0309756 | A1 | 10/2019 | Shaw et al. | F04D 15/0011 |

FOREIGN PATENT DOCUMENTS

| | | | | |
|---|---|---|---|---|
| CN | 101985935 | B | 3/2011 | F04C 18/14 |
| CN | 101985937 | B | 3/2011 | F04C 18/14 |
| CN | 102828952 | B | 12/2012 | F04C 25/02 |
| CN | 202690445 | U | 1/2013 | F04C 23/00 |
| CN | 202851357 | U | 4/2013 | F04C 18/14 |
| CN | 202867219 | U | 4/2013 | F04C 18/14 |
| CN | 103089647 | B | 5/2013 | F04C 18/14 |
| CN | 103486034 | B | 1/2014 | F04C 25/02 |
| CN | 105222980 | B | 1/2016 | G01M 9/04 |
| CN | 205383080 | U | 7/2016 | F04C 23/02 |
| CN | 105864036 | A | 8/2016 | F04C 18/12 |
| CN | 205779709 | U | 12/2016 | F04C 23/00 |
| CN | 107420306 | * | 1/2017 | F04C 18/14 |
| CN | 106499631 | A | 3/2017 | F04C 18/12 |
| CN | 106949050 | B | 7/2017 | F04C 18/12 |
| CN | 107061284 | A | 8/2017 | F04C 25/02 |
| CN | 206377025 | U | 8/2017 | F04C 18/04 |
| CN | 108317080 | A | 7/2018 | F04C 18/12 |
| CN | 108799112 | B | 11/2018 | F04C 18/12 |
| CN | 108953146 | A | 12/2018 | F04C 18/12 |
| CN | 109026710 | A | 12/2018 | F04C 18/12 |
| CN | 109058110 | A | 12/2018 | F04C 18/12 |
| CN | 209414166 | U | 9/2019 | F04C 23/00 |
| EP | 0953771 | A1 | 11/1999 | F04C 23/00 |
| EP | 2461040 | A1 | 6/2012 | F04C 18/12 |
| EP | 3434905 | A1 | 1/2019 | F04D 19/04 |
| GB | 2417757 | A | 3/2006 | F04C 18/14 |
| JP | 3-145594 | | 6/1991 | F04C 29/04 |
| JP | 2009287579 | A | 12/2009 | F16D 1/09 |
| WO | WO2020/160770 | A1 | 8/2020 | F01C 21/10 |

* cited by examiner

PUMP HOUSING STRUCTURE OF THREE-AXIS MULTI-STAGE ROOTS PUMP

TECHNICAL FIELD

The present invention relates to the technical field of Roots pumps, in particular to a pump housing structure of a three-axis multi-stage Roots pump.

BACKGROUND

The three-axis multi-stage Roots pump is a new oil-free dry vacuum pump. The pump chamber at each stage is provided with three parallel axes. The three pump axes rotate at the same speed, and the center pump axis rotates in the direction opposite to the direction in which its adjacent left pump axis and its adjacent right pump axes rotate; the pump chamber at each stage is provided with a pair of rotors. The pairs of rotors of an odd-numbered-stage pump chamber are connected to the center pump axis and its adjacent left pump axis, respectively. The pairs of rotors of an even-numbered-stage pump chamber are connected to the center pump axis and its adjacent right pump axis, respectively. In such a way, a unique airflow passage is formed, that is, the lower ports of the adjacent pump chambers are an air outlet and an air inlet, respectively, and the airflow directly enters the air inlet at the latter stage from the air outlet at the previous stage.

This unique structure has advantages of large pumping capacity, high volumetric efficiency, low power, no fear of dust, no fear of corrosion, and long service life compared to screw, scroll, reciprocating and other dry vacuum pumps. However, the existing three-axis multi-stage Roots pump has a complicated pump housing structure, and requires a plurality of pump housings to be connected. The connection of the pump housing at each stage also requires an intermediate partition. Due to the series connection of a plurality of components, a large cumulative error is formed, and the mounting process becomes very complicated, resulting in a decrease in product stability. Therefore, in order to better optimize the pump housing structure of the three-axis multi-stage Roots pump, simplify the structure and quantity of the parts, reduce the cumulative error of the parts, and improve the qualification rate of the one-time mounting of the product, a better optimized pump structure is required.

SUMMARY

In view of the deficiencies of the prior art, the present invention provides a pump housing structure of a three-axis multi-stage Roots pump, which overcomes the deficiencies of the prior art and has a reasonable design. The three fixed bearing chambers on the surface of the fixed bearing end cover can accommodate and fix three axes of the Roots pump, respectively. Moreover, since the sum of the axial lengths of the second-stage pump housing and the third-stage pump housing is equal to the axial length of the first-stage pump housing, the fixed bearing chamber is used for fixing, which not only can strengthen the center stiffness of the three axes of the Roots pump, but also can ensure that the total axial expansion is evenly divided, reducing the cumulated amount of thermal expansion at the end of the axis.

To achieve the above object, the present invention is achieved by the following technical solutions.

A pump housing structure of a three-axis multi-stage Roots pump, comprising a first-stage pump housing, a second-stage pump housing and a third-stage pump housing, wherein: the first-stage pump housing is provided with a first center axial hole, a first left axial hole and a first right axial hole, the first center axial hole and the first left axial hole form a first-stage rotor pump chamber capable of accommodating a pair of first-stage Roots rotor axes, the first right axial hole is an independent closed axial hole, one side of the first-stage pump housing is fixedly connected to a driving end gear end cover; the other side of the first-stage pump housing is fixedly mounted with a fixed bearing end cover, the fixed bearing end cover is provided with three fixed bearing chambers on its surface, and the three fixed bearing chambers correspond to the first center axial hole, the first left axial hole and the first right axial hole, respectively; the end surface at one side of the second-stage pump housing is fixedly mounted on the fixed bearing end cover, the second-stage pump housing is provided with a second center axial hole, a second a left axial hole and a second right axial hole, the third-stage pump housing is fixedly mounted on the other end surface of the second-stage pump housing, the third-stage pump housing is provided with a third center axial hole, a third left axial hole and a third right axial hole, the first center axial hole, the second center axial hole and the third center axial hole are coaxially connected, the first left axial hole, the second left axial hole and the third left axial hole are coaxially connected, the first right axial hole, the second right axial hole and the third right axial hole are coaxially connected, and the end surface at the outer side of the third-stage pump housing is fixedly mounted with a non-driving end bearing end cover.

Preferably, the sum of the axial length of the second-stage pump housing and the third-stage pump housing is equal to the axial length of the first-stage pump housing.

Preferably, the side of the second-stage pump housing adjacent to the first-stage pump housing is provided with a second-stage rotor pump chamber capable of accommodating a pair of second-stage Roots rotor axes, the second-stage rotor pump chamber consists of a second center axial hole and a second left axial hole, the side of the second-stage pump housing adjacent to the third-stage pump housing is provided with a three-stage rotor pump chamber capable of accommodating a pair of three-stage Roots rotor axes, the three-stage rotor pump chamber consists of a second center axial hole and a second right axial hole, the second-stage rotor pump chamber and the three-stage rotor pump chamber pass through the center axis passage of the second center axial hole to misalign the center axis, and the second-stage rotor pump chamber and the three-stage rotor pump chamber are separated by a first intermediate partition to form two separate pump chambers.

Preferably, the side of the third-stage pump housing adjacent to the second-stage pump housing is provided with a four-stage rotor pump chamber capable of accommodating a pair of four-stage Roots rotor axes, the fourth-stage rotor pump chamber consists of a third center axial hole and a third left axial hole, the four-stage rotor pump chamber corresponds to the three-stage rotor pump chamber, the other side of the third-stage pump housing is provided with a five-stage rotor pump chamber capable of accommodating a pair of five-stage Roots rotor axes, the five-stage rotor pump chamber consists of a third center axial hole and a third right axial hole, the four-stage rotor pump chamber and the five-stage rotor pump chamber pass through the center axis passage of the third center axial hole to misalign the center axis, and the four-stage rotor pump chamber and the five-stage rotor pump chamber are separated by a second intermediate partition to form two separate pump chambers.

Preferably, a first air inlet perpendicular to the first center axial hole is provided above the first-stage pump housing, a first air outlet parallel to the first center axial hole is provided under the first-stage pump housing; the first air outlet is communicated with a second air inlet provided on one side of the second-stage rotor pump chamber, the other side of the second-stage rotor pump chamber is provided with a second air outlet, the second air outlet is communicated with the third air inlet through the first intermediate passage, the third air inlet is provided at one side of the three-stage rotor pump chamber, the other side of the three-stage rotor pump chamber is provided with a third air outlet; the third air outlet is communicated with a fourth air inlet provided on one side of the four-stage rotor pump chamber, the other side of the four-stage rotor pump chamber is provided with a fourth air outlet, the fourth air outlet is communicated with a fifth air inlet through the second intermediate passage, the fifth air inlet is provided at one side of the five-stage rotor pump chamber, the other side of the five-stage rotor pump chamber is provided with a fifth air outlet, and the fifth air outlet is communicated with the outside.

Preferably, a cooling water interlayer is provided inside the first-stage pump housing, the second-stage pump housing and the third-stage pump housing, respectively, both end surfaces of the first-stage pump housing, both end surfaces of the second-stage pump housing, and both end surfaces of the third-stage pump housing are provided with cooling water passages, the cooling water interlayers are communicated by the cooling water passage, and the cooling water interlayer is provided with a reinforcing rib.

Preferably, both end surfaces of the first-stage pump housing, both end surfaces of the second-stage pump housing, and both end surfaces of the third-stage pump housing are provided with seal ring grooves, a seal ring is mounted in the seal ring groove, and the seal ring groove surrounds the entire rotor pump chamber and separate closed axial holes.

Preferably, both end surfaces of the first-stage pump housing, both end surfaces of the second-stage pump housing, and both end surfaces of the third-stage pump housing are provided with fixing bolt holes and positioning pin holes, fixing bolts are mounted in the fixing bolt holes, and the first-stage pump housing, the second-stage pump housing and the third-stage pump housing are sequentially fixedly connected by the fixing bolts.

Preferably, both sides of the first-stage pump housing and both sides of the second-stage pump housing are provided with casting process holes, both sides of the third-stage pump housing are provided with water interlayer through-holes, and both the casting process hole and the water interlayer through-hole are communicated with the cooling water interlayer.

Preferably, the first-stage pump housing and the third-stage pump housing are fixedly mounted with mounting bases at the bottom thereof.

The present invention provides a pump housing structure of a three-axis multi-stage Roots pump. The following beneficial effects are obtained: during operation, the three axes of the Roots pump pass through the center axial hole, the left axial hole and the right axial hole respectively. The three fixed bearing chambers on the surface of the fixed bearing end cover can accommodate and fix three axes of the Roots pump, respectively. Moreover, since the sum of the axial lengths of the second-stage pump housing and the third-stage pump housing is equal to the axial length of the first-stage pump housing, the fixed bearing chamber is used for fixing, which not only can strengthen the center stiffness of the three axes of the Roots pump, but also can ensure that the total axial expansion is evenly divided, reducing the cumulated amount of thermal expansion at the end of the axis. The Roots rotors are mounted in the first-stage rotor pump chamber, the second-stage rotor pump chamber, the three-stage rotor pump chamber, the four-stage rotor pump chamber and the five-stage rotor pump chamber. Two sets of Roots rotors are misaligned, thus ensuring the stability of the Roots rotor during operation. It is also possible to improve the operating efficiency of the Roots pump through the interaction of a plurality of sets of Roots rotors; simplify the airflow passage through the unique airflow direction of the three-axis pump, and achieve a better sealing performance, reducing the original series connection of a plurality of parts.

BRIEF DESCRIPTION OF THE DRAWINGS

In order to more clearly illustrate the present invention or the technical solutions in the prior art, the drawings used in the description of the prior art will be briefly described below.

DESCRIPTION OF THE REFERENCE SIGNS IN THE FIGURE

1, a first-stage pump housing; 2, a second-stage pump housing; 3, a third-stage pump housing; 4, a first center axial hole; 5, a first left axial hole; 6, a first right axial hole; 7, a first-stage rotor pump chamber; 8, a fixing bolt hole; 9, a driving end gear end cover; 10, a fixed bearing end cover; 11, a fixed bearing chamber; 12, a non-driving end bearing end cover; 13, a positioning pin hole; 14, a second center axial hole; 15, a second left axial hole; 16, a second right axial hole; 17, a third center axial hole; 18, a third left axial hole; 19, a third right axis hole; 20, a second-stage rotor pump chamber; 21, a three-stage rotor pump chamber; 22, a first intermediate partition; 23, a four-stage rotor pump chamber; 24, a five-stage rotor pump chamber; 25, a second intermediate partition, 26, a first air inlet; 27, a first air outlet; 28, a second air inlet; 29, a second air outlet; 30, a first intermediate passage; 31, a third air inlet; 32, a third air outlet; 33, a fourth air inlet; 34, a fourth air outlet; 35, a second intermediate passage; 36, a fifth air inlet; 37, a fifth air outlet; 38, a cooling water interlayer; 39, a cooling water passage; 40, a reinforcing rib; 41, a seal ring groove; 42, a casting process hole 43, a water interlayer through-hole; 44, a mounting base.

DESCRIPTION OF THE EMBODIMENTS

In order to make the object, the technical solution and the advantage of the present invention clearer, the technical solution in the present invention will be clearly and completely described below in conjunction with the drawings in the present invention.

Figure 1:
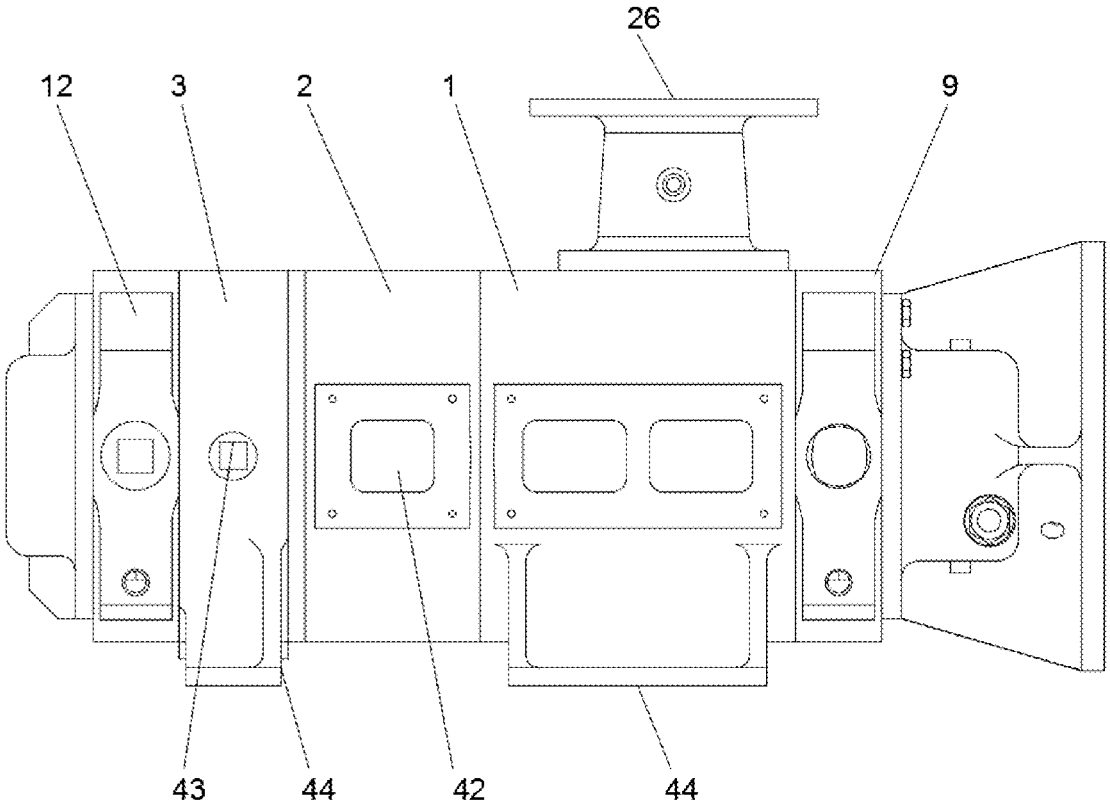
FIG. 1 is a schematic diagram illustrating the structure of the present invention.
Figure 2:
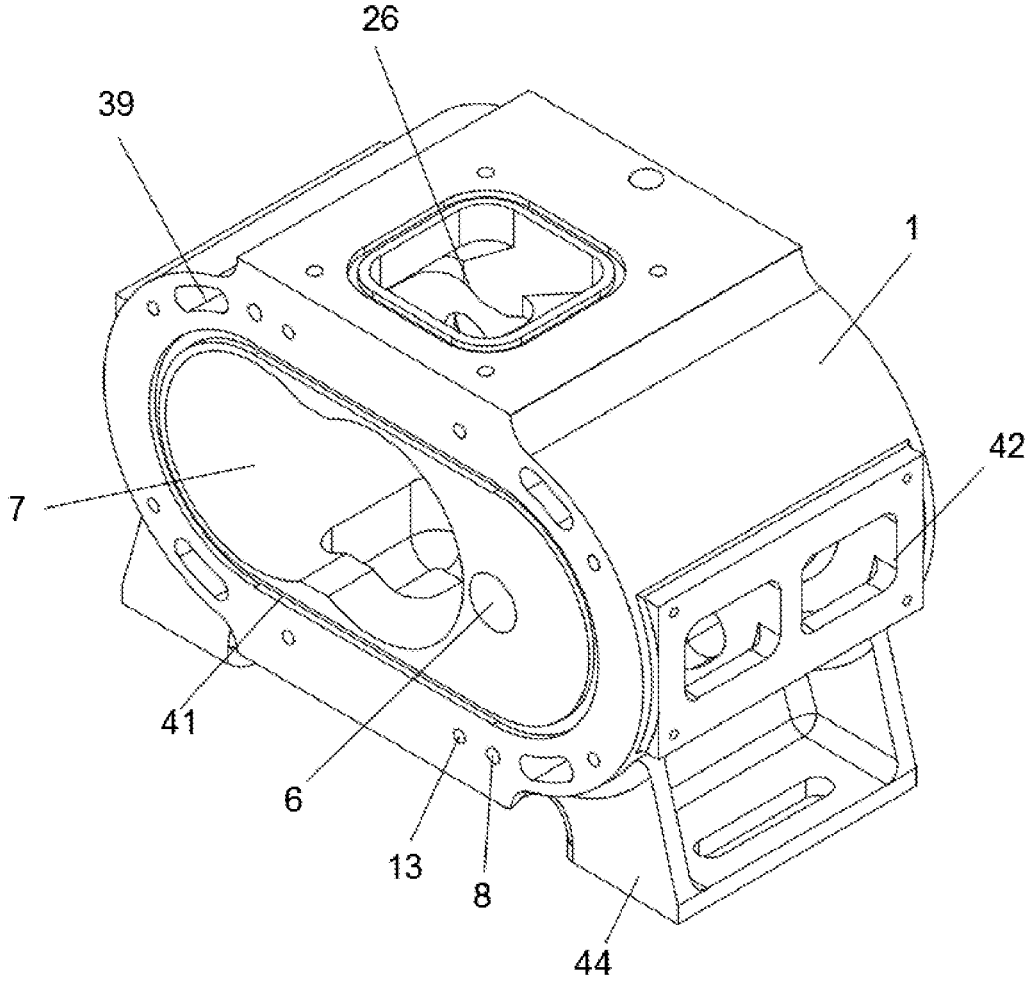
FIG. 2 is a perspective diagram 1 illustrating a first-stage pump housing according to the present invention.
Figure 3:
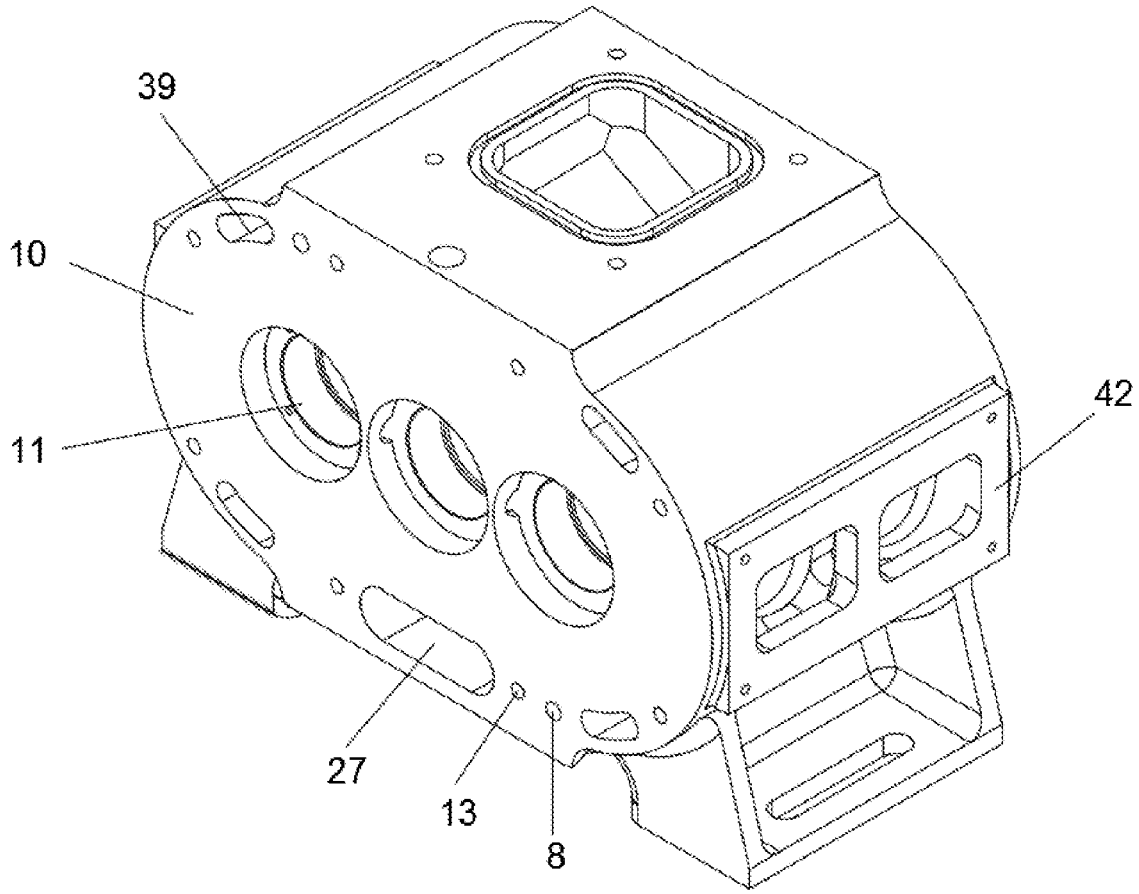
FIG. 3 is a perspective diagram 2 illustrating a first-stage pump housing according to the present invention.
Figure 4:
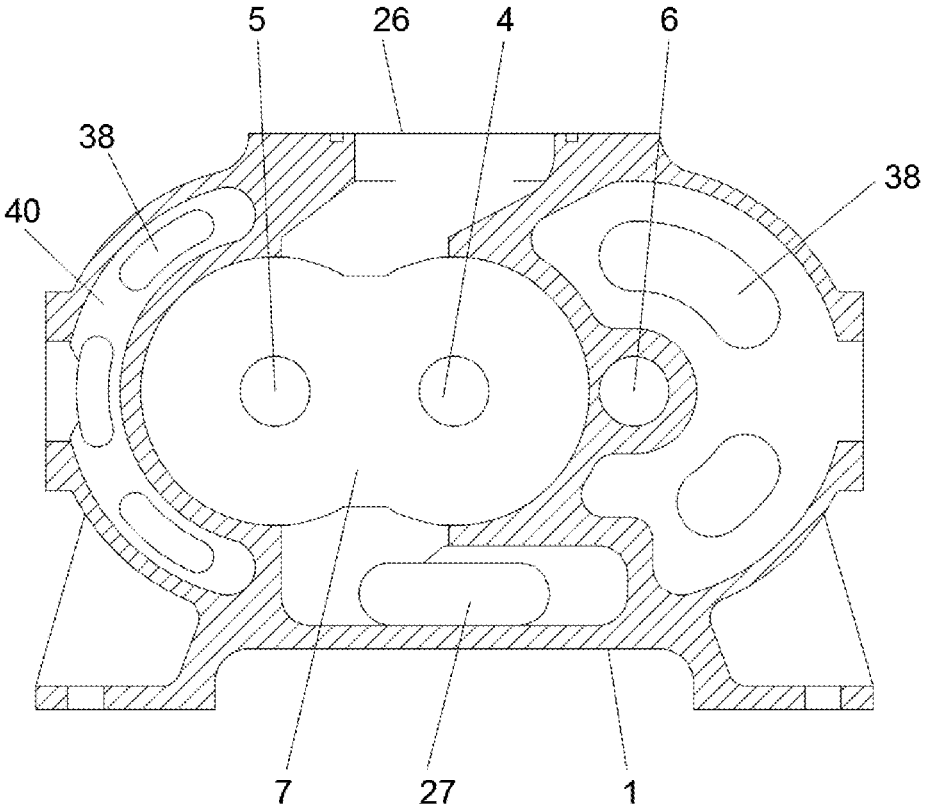
FIG. 4 is a cross-sectional diagram illustrating a first-stage pump housing according to the present invention.
Figure 5:
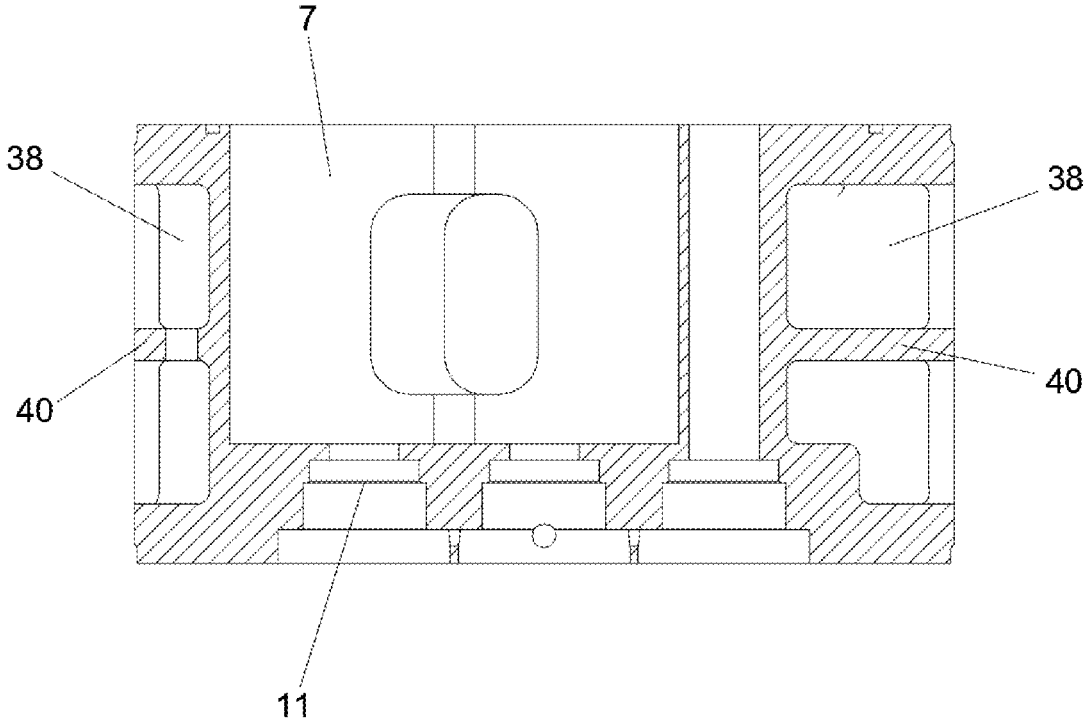
FIG. 5 is a plan cross-sectional diagram illustrating a first-stage pump housing according to the present invention.
Figure 6:
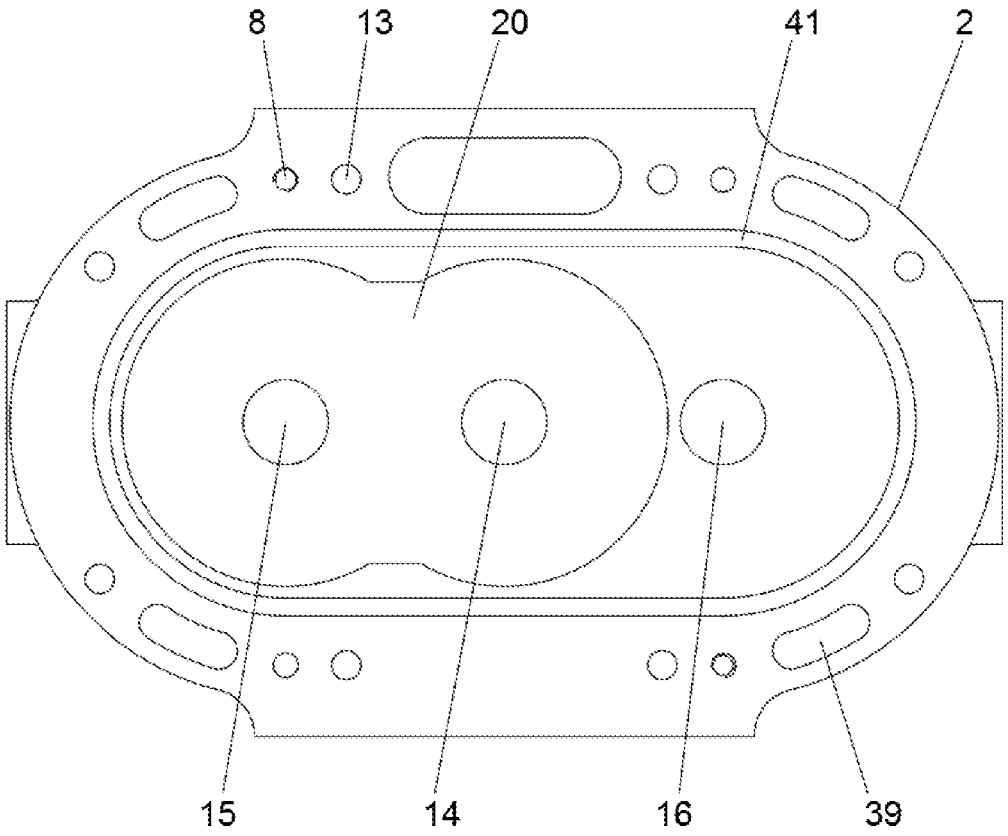
FIG. 6 is a cross-sectional diagram illustrating a second-stage pump housing according to the present invention.
Figure 7:
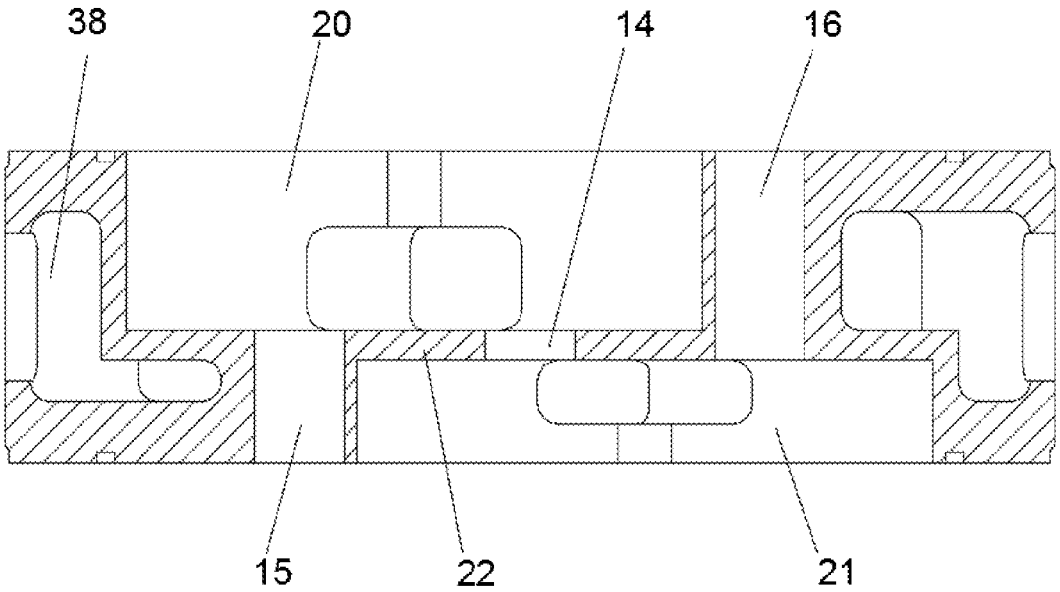
FIG. 7 is a plan cross-sectional diagram illustrating a second-stage pump housing according to the present invention.
Figure 8:
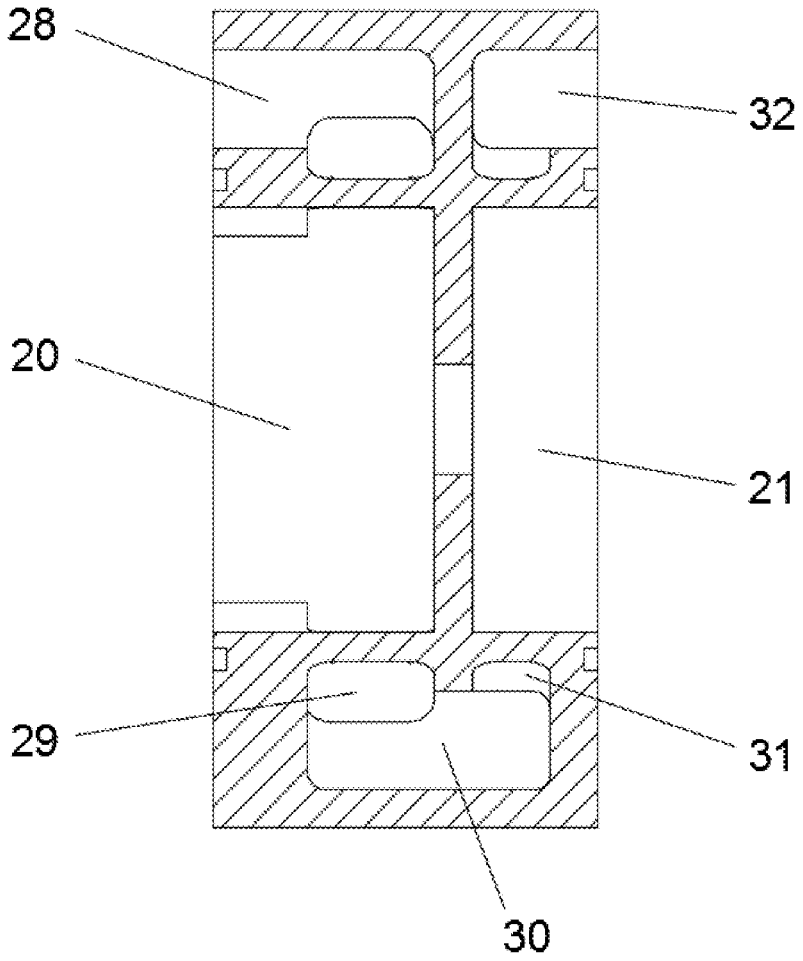
FIG. 8 is a perspective cross-sectional diagram illustrating a second-stage pump housing according to the present invention.
Figure 9:
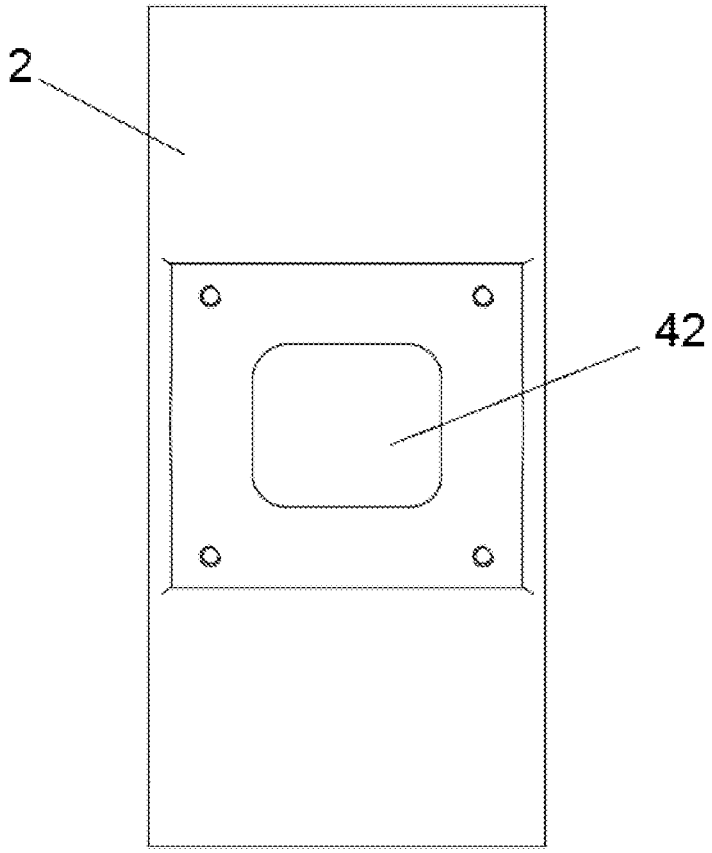
FIG. 9 is a side diagram illustrating a second-stage pump housing according to the present invention.
Figure 10:
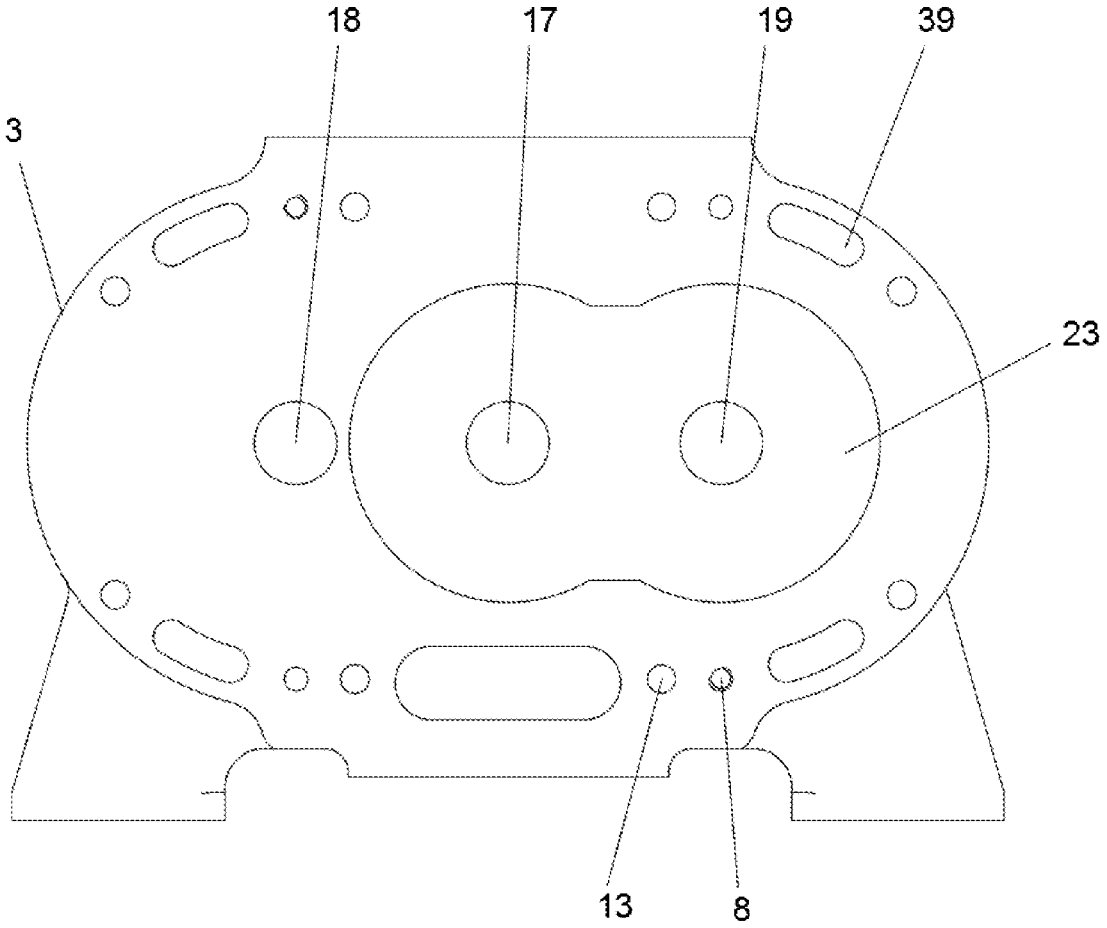
FIG. 10 is a cross-sectional diagram illustrating a third-stage pump housing according to the present invention.
Figure 11:
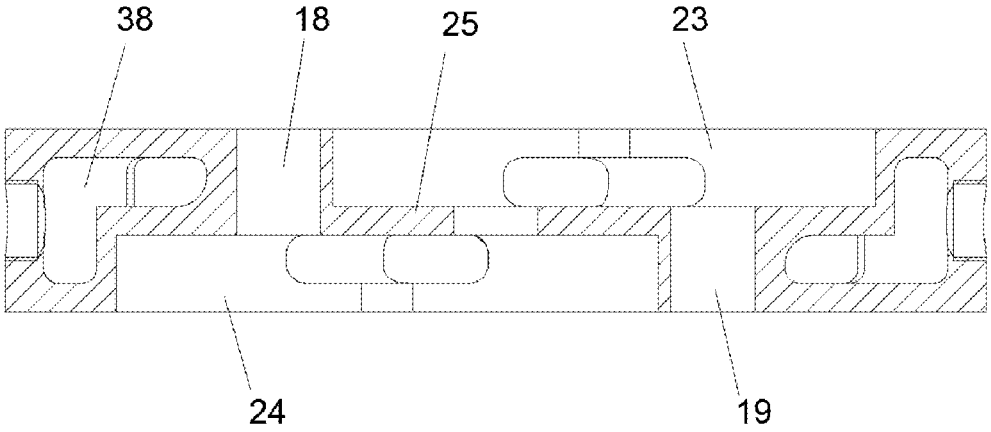
FIG. 11 is a plan cross-sectional diagram illustrating a third-stage pump housing according to the present invention.
Figure 12:
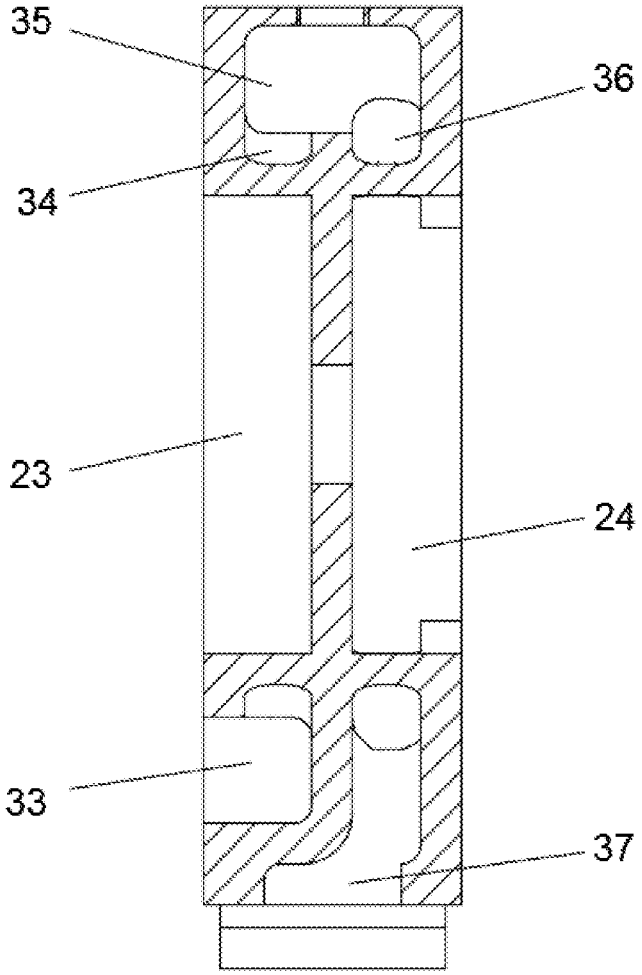
FIG. 12 is a perspective cross-sectional diagram illustrating a third-stage pump housing according to the present invention.
Figure 13:
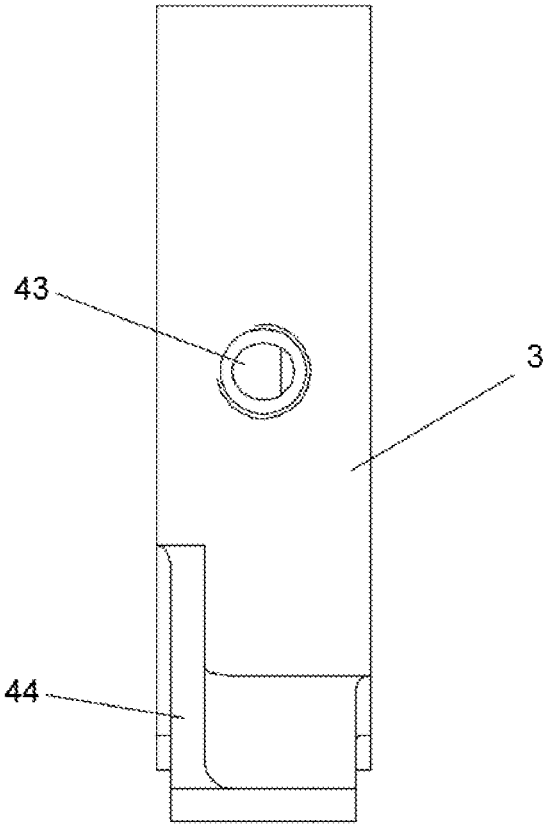
FIG. 13 is a side diagram illustrating a third-stage pump housing according to the present invention.

As shown in FIG. 1-13, a pump housing structure of a three-axis multi-stage Roots pump comprises a first-stage pump housing 1, a second-stage pump housing 2 and a third-stage pump housing 3, the first-stage pump housing 1 is provided with a first center axial hole 4, a first left axial hole 5 and a first right axial hole 6, the first center axial hole 5 and the first left axial hole 6 form a first-stage rotor pump chamber 7 capable of accommodating a pair of first-stage Roots rotor axes, the first right axial hole 6 is an independent closed axial hole, one side of the first-stage pump housing 1 is fixedly connected to a driving end gear end cover 9; the other side of the first-stage pump housing 1 is fixedly mounted with a fixed bearing end cover 10, the fixed bearing end cover 10 is provided with three fixed bearing chambers 11 on its surface, and the three fixed bearing chambers 10 correspond to the first center axial hole 4, the first left axial hole 5 and the first right axial hole 6, respectively; the end surface at one side of the second-stage pump housing 2 is fixedly mounted on the fixed bearing end cover 10, the second-stage pump housing 2 is provided with a second center axial hole 14, a second a left axial hole 15 and a second right axial hole 16, the third-stage pump housing 3 is fixedly mounted on the other end surface of the second-stage pump housing 2, the third-stage pump housing 3 is provided with a third center axial hole 17, a third left axial hole 18 and a third right axial hole 19, the first center axial hole 4, the second center axial hole 14 and the third center axial hole 17 are coaxially connected, the first left axial hole 5, the second left axial hole 15 and the third left axial hole 18 are coaxially connected, the first right axial hole 6, the second right axial hole 16 and the third right axial hole 19 are coaxially connected, and the end surface at the outer side of the third-stage pump housing 3 is fixedly mounted with a non-driving end bearing end cover 12.

During operation, the three axes of the Roots pump pass through the center axial hole, the left axial hole and the right axial hole respectively. The three fixed bearing chambers 10 on the surface of the fixed bearing end cover 10 can accommodate and fix three axes of the Roots pump, respectively. Moreover, since the sum of the axial lengths of the second-stage pump housing 2 and the third-stage pump housing 3 is equal to the axial length of the first-stage pump housing 1, the fixed bearing chamber 10 is used for fixing, which not only can strengthen the center stiffness of the three axes of the Roots pump, but also can ensure that the total axial expansion is evenly divided, reducing the cumulated amount of thermal expansion at the end of the axis.

Further, the side of the second-stage pump housing 2 adjacent to the first-stage pump housing 1 is provided with a second-stage rotor pump chamber 20 capable of accommodating a pair of second-stage Roots rotor axes, the second-stage rotor pump chamber 20 consists of a second center axial hole 14 and a second left axial hole 15, the side of the second-stage pump housing 2 adjacent to the third-stage pump housing 3 is provided with a three-stage rotor pump chamber 21 capable of accommodating a pair of three-stage Roots rotor axes, the three-stage rotor pump chamber 21 consists of a second center axial hole 14 and a second right axial hole 16, the second-stage rotor pump chamber 20 and the three-stage rotor pump chamber 21 pass through the center axis passage of the second center axial hole 14 to misalign the center axis, and the second-stage rotor pump chamber 20 and the three-stage rotor pump chamber 21 are separated by a first intermediate partition 22 to form two separate pump chambers. The second left axial hole 15 adjacent to the second-stage rotor pump chamber 20 is a separate closed axial hole, and the second right axial hole 16 adjacent to the three-stage rotor pump chamber 21 is also a separate closed axial hole.

The side of the third-stage pump housing 3 adjacent to the second-stage pump housing 2 is provided with a four-stage rotor pump chamber 23 capable of accommodating a pair of four-stage Roots rotor axes, the fourth-stage rotor pump chamber 23 consists of a third center axial hole 17 and a third left axial hole 18, the four-stage rotor pump chamber 23 corresponds to the three-stage rotor pump chamber 21, the other side of the third-stage pump housing 3 is provided with a five-stage rotor pump chamber 24 capable of accommodating a pair of five-stage Roots rotor axes, the five-stage rotor pump chamber 24 consists of a third center axial hole 17 and a third right axial hole 19, the four-stage rotor pump chamber 23 and the five-stage rotor pump chamber 24 pass through the center axis passage of the third center axial hole 17 to misalign the center axis, and the four-stage rotor pump chamber 23 and the five-stage rotor pump chamber 24 are separated by a second intermediate partition 25 to form two separate pump chambers. The third left axial hole 18 adjacent to the four-stage rotor pump chamber 23 is a separate closed axial hole, and the third right axial hole 19 adjacent to the five-stage rotor pump chamber 24 is also a separate closed axial hole. The Roots rotors are mounted in the first-stage rotor pump chamber 7, the second-stage rotor pump chamber 20, the three-stage rotor pump chamber 21, the four-stage rotor pump chamber 23 and the five-stage rotor pump chamber 24. Two sets of Roots rotors are misaligned, thus ensuring the stability of the Roots rotor during operation. It is also possible to improve the operating efficiency of the Roots pump through the interaction of a plurality of sets of Roots rotors.

Further, a first air inlet 26 perpendicular to the first center axial hole 4 is provided above the first-stage pump housing 1, a first air outlet 27 parallel to the first center axial hole 4 is provided under the first-stage pump housing 1; the first air outlet 27 is communicated with a second air inlet 28 provided on one side of the second-stage rotor pump chamber 20, the other side of the second-stage rotor pump chamber 20 is provided with a second air outlet 29, the second air outlet 29 is communicated with the third air inlet 31 through the first intermediate passage 30, the third air inlet 31 is provided at one side of the three-stage rotor pump chamber 21, the other side of the three-stage rotor pump chamber 21 is provided with a third air outlet 32; the third air outlet 32 is communicated with a fourth air inlet 33 provided on one side of the four-stage rotor pump chamber 23, the other side of the four-stage rotor pump chamber 23 is provided with a fourth air outlet 34, the fourth air outlet 34 is communicated with a fifth air inlet 36 through the second intermediate passage 35, the fifth air inlet 36 is provided at one side of the five-stage rotor pump chamber 24, the other side of the five-stage rotor pump chamber 24 is provided with a fifth air outlet 37, and the fifth air outlet 37 is communicated with the outside.

The process air enters the first-stage rotor pump chamber 7 from the first air inlet 26, is discharged from the first air outlet 27, enters the second-stage rotor pump chamber 20 through the second air inlet 28, then leaves the second-stage rotor pump chamber 20 from the second air outlet 29 and enters the three-stage rotor pump chamber 21 from the third air inlet 31 through the first intermediate passage 30, then leaves the three-stage rotor pump chamber 21 from the third air outlet 32 and enters the fourth air inlet 33, enters the fourth-stage rotor pump chamber 23 from the fourth air inlet 33, then leaves the fourth-stage rotor pump chamber 23 from the fourth air outlet 34 and enters the fifth air inlet 36 through the second intermediate passage 35, enters the fifth-stage rotor pump chamber 24 from the fifth air inlet 36, and then is discharged from the third-stage pump housing 3 through the fifth air outlet 37; wherein the second air outlet 29 and the third air inlet 31 are connected by the first intermediate passage 30 in the same axial direction, the second air inlet 28 is separated from the third air outlet 32 by the partition in the same axial direction, the fourth air outlet 34 and the fifth air outlet 37 are connected by the second intermediate passage 35 in the same axial direction, the fourth air inlet 33 is separated from the fifth air outlet 37 by the partition in the same axial direction, thereby enabling the unique airflow direction of the three-axis pump, simplifying the airflow passage, realizing a better sealing performance, and reducing the original series connection of a plurality of parts; the bottom of the first-stage pump housing 1 can be provided with a liquid discharging port, and the liquid discharging port is communicated with the first-stage rotor pump chamber 7, so that after the water contained in the process air enters the first-stage rotor pump chamber 7 from the first air inlet 26, the water can be discharged from the liquid discharging port, thereby avoiding the accumulation of water in the first-stage rotor pump chamber 7.

Further, a cooling water interlayer 38 is provided inside the first-stage pump housing 1, the second-stage pump housing 2 and the third-stage pump housing 3, respectively, both end surfaces of the first-stage pump housing 1, both end surfaces of the second-stage pump housing 2, and both end surfaces of the third-stage pump housing 3 are provided with four elliptical cooling water passages 39 on the upper, lower, left and right sides, the cooling water interlayers 38 are communicated by the cooling water passage 39, and the cooling water interlayer 38 is provided with a reinforcing rib 40. The first-stage pump housing 1, the second-stage pump housing 2, the third-stage pump housing 3, the driving end gear end cover 9 and the non-driving end bearing end cover 12 can be cooled in operation by the cooling water passage 39. The reinforcing rib is provided to enhance the strength of the pump housing and reduce the amount of deformation in actual operation; and the cooling water in each of the cooling water interlayers 38 can be circulated through the four elliptical cooling water passages 39.

Further, both end surfaces of the first-stage pump housing 1, both end surfaces of the second-stage pump housing 2, and both end surfaces of the third-stage pump housing 3 are provided with seal ring grooves 41, a seal ring is mounted in the seal ring groove 41, and the seal ring groove 41 surrounds the entire rotor pump chamber and separate closed axial holes. The air and the cooling water located outside the rotor pump chamber and separate closed axial holes cannot be leaked under the action of the seal ring; fixing bolt holes 8 and positioning pin holes 13 are provided at the periphery of the seal ring groove 41, fixing bolts are mounted in the fixing bolt holes 8, and the fixing bolt holes 8 are used to fixedly connect the first-stage pump housing 1, the second-stage pump housing 2, the third-stage pump housing 3, the driving end gear end cover 9 and the non-driving end bearing end cover 12. The positioning pin holes 13 are used for precise alignment when connected.

Further, both sides of the first-stage pump housing 1 and both sides of the second-stage pump housing 2 are provided with casting process holes 42, both sides of the third-stage pump housing 3 are provided with water interlayer through-holes 43, and both the casting process hole 42 and the water interlayer through-hole 43 are communicated with the cooling water interlayer 38 in order to facilitate casting. In actual use, the casting process holes 42 are sealed by a cover plate, and the water interlayer through-hole 43 is sealed by a wire plug.

Further, the first-stage pump housing 1 and the third-stage pump housing 3 are fixedly mounted with mounting bases 44 at the bottom thereof. The base 44 at the bottom of the third-stage pump housing 3 and the base 44 at the bottom of the first-stage pump housing 1 form the base of the entire pump, which not only stabilizes the entire pump but also facilitates the mounting of the entire pump.

The above embodiments are merely used to illustrate the technical solutions of the present invention, and are not intended to be limiting; although the present invention has been described in detail with reference to the above embodiments, it will be understood by those of ordinary skill in the art that the technical solutions described by the above embodiments are modified, or some of its technical features are equivalently replaced. However, these modifications or replacements do not cause the essence of the corresponding technical solutions to depart from the spirit and scope of the technical solutions of various embodiments of the present invention.

What is claimed is:

1. A pump housing structure of a three-axis multi-stage Roots pump, comprising a first-stage pump housing (1), a second-stage pump housing (2) and a third-stage pump housing (3), wherein the first-stage pump housing (1) is provided with a first center axial hole (4), a first left axial hole (5) and a first right axial hole (6), the first center axial hole (5) and the first left axial hole (6) form a first-stage rotor pump chamber (7) capable of accommodating a pair of first-stage Roots rotor axes, the first right axial hole (6) is an independent closed axial hole, one side of the first-stage pump housing (1) is fixedly connected to a driving end gear end cover (9); the other side of the first-stage pump housing (1) is fixedly mounted with a fixed bearing end cover (10), the fixed bearing end cover (10) is provided with three fixed bearing chambers (11) on its surface, and the three fixed bearing chambers (10) correspond to the first center axial hole (4), the first left axial hole (5) and the first right axial hole (6), respectively;

an end surface at one side of the second-stage pump housing (2) is fixedly mounted on the fixed bearing end cover (10), the second-stage pump housing (2) is provided with a second center axial hole (14), a second a left axial hole (15) and a second right axial hole (16), the third-stage pump housing (3) is fixedly mounted on the other end surface of the second-stage pump housing (2), the third-stage pump housing (3) is provided with a third center axial hole (17), a third left axial hole (18) and a third right axial hole (19), the first center axial hole (4), the second center axial hole (14) and the third center axial hole (17) are coaxially connected, the first left axial hole (5), the second left axial hole (15) and the third left axial hole (18) are coaxially connected, the first right axial hole (6), the second right axial hole (16) and the third right axial hole (19) are coaxially connected, the end surface at an outer side of the third-stage pump housing (3) is fixedly mounted with a non-driving end bearing end cover (12), and a sum of an axial length of the second-stage pump housing (2) and the third-stage pump housing (3) is equal to an axial length of the first-stage pump housing (1).

2. The pump housing structure of a three-axis multi-stage Roots pump according to claim 1, wherein a side of the second-stage pump housing (2) adjacent to the first-stage pump housing (1) is provided with a second-stage rotor pump chamber (20) capable of accommodating a pair of second-stage Roots rotor axes, the second-stage rotor pump chamber (20) consists of a second center axial hole (14) and a second left axial hole (15), the side of the second-stage pump housing (2) adjacent to the third-stage pump housing (3) is provided with a three-stage rotor pump chamber (21) capable of accommodating a pair of three-stage Roots rotor axes, the three-stage rotor pump chamber (21) consists of a second center axial hole (14) and a second right axial hole (16), the second-stage rotor pump chamber (20) and the three-stage rotor pump chamber (21) pass through the center axis passage of the second center axial hole (14) to misalign the center axis, and the second-stage rotor pump chamber (20) and the three-stage rotor pump chamber (21) are separated by a first intermediate partition (22) to form two separate pump chambers.

3. The pump housing structure of a three-axis multi-stage Roots pump according to claim 2, wherein a side of the third-stage pump housing (3) adjacent to the second-stage pump housing (2) is provided with a four-stage rotor pump chamber (23) capable of accommodating a pair of four-stage Roots rotor axes, the fourth-stage rotor pump chamber (23) consists of a third center axial hole (17) and a third left axial hole (18), the four-stage rotor pump chamber (23) corresponds to the three-stage rotor pump chamber (21), the other side of the third-stage pump housing (3) is provided with a five-stage rotor pump chamber (24) capable of accommodating a pair of five-stage Roots rotor axes, the five-stage rotor pump chamber (24) consists of a third center axial hole (17) and a third right axial hole (19), the four-stage rotor pump chamber (23) and the five-stage rotor pump chamber (24) pass through the center axis passage of the third center axial hole (17) to misalign the center axis, and the four-stage rotor pump chamber (23) and the five-stage rotor pump chamber (24) are separated by a second intermediate partition (25) to form two separate pump chambers.

4. The pump housing structure of a three-axis multi-stage Roots pump according to claim 3, wherein a first air inlet (26) perpendicular to the first center axial hole (4) is provided above the first-stage pump housing (1), a first air outlet (27) parallel to the first center axial hole (4) is provided under the first-stage pump housing (1); the first air outlet (27) is communicated with a second air inlet (28) provided on one side of the second-stage rotor pump chamber (20), the other side of the second-stage rotor pump chamber (20) is provided with a second air outlet (29), the second air outlet (29) is communicated with the third air inlet (31) through the first intermediate passage (30), the third air inlet (31) is provided at one side of the three-stage rotor pump chamber (21), the other side of the three-stage rotor pump chamber (21) is provided with a third air outlet (32); the third air outlet (32) is communicated with a fourth air inlet (33) provided on one side of the four-stage rotor pump chamber (23), the other side of the four-stage rotor pump chamber (23) is provided with a fourth air outlet (34), the fourth air outlet (34) is communicated with a fifth air inlet (36) through the second intermediate passage (35), the fifth air inlet (36) is provided at one side of the five-stage rotor pump chamber (24), the other side of the five-stage rotor pump chamber (24) is provided with a fifth air outlet (37), and the fifth air outlet (37) is communicated with the outside.

5. The pump housing structure of a three-axis multi-stage Roots pump according to claim 3, wherein a cooling water interlayer (38) is provided inside the first-stage pump housing (1), the second-stage pump housing (2) and the third-stage pump housing (3), respectively, both end surfaces of the first-stage pump housing (1), both end surfaces of the second-stage pump housing (2), and both end surfaces of the third-stage pump housing (3) are provided with cooling water passages (39), the cooling water interlayers (38) are communicated by the cooling water passage (39), and the cooling water interlayer (38) is provided with a reinforcing rib (40).

6. The pump housing structure of a three-axis multi-stage Roots pump according to claim 5, wherein both sides of the first-stage pump housing (1) and both sides of the second-stage pump housing (2) are provided with casting process holes (42), both sides of the third-stage pump housing (3) are provided with water interlayer through-holes (43), and both the casting process hole (42) and the water interlayer through-hole (43) are communicated with the cooling water interlayer (38).

7. The pump housing structure of a three-axis multi-stage Roots pump according to claim 3, wherein both end surfaces of the first-stage pump housing (1), both end surfaces of the second-stage pump housing (2), and both end surfaces of the third-stage pump housing (3) are provided with seal ring grooves (41), a seal ring is mounted in the seal ring groove (41), and the seal ring groove (41) surrounds the entire rotor pump chamber and separate closed axial holes.

8. The pump housing structure of a three-axis multi-stage Roots pump according to claim 1, wherein both end surfaces of the first-stage pump housing (1), both end surfaces of the second-stage pump housing (2), and both end surfaces of the third-stage pump housing (3) are provided with fixing bolt holes (8) and positioning pin holes (13), fixing bolts are mounted in the fixing bolt holes (8), and the first-stage pump housing (1), the second-stage pump housing (2) and the third-stage pump housing (3) are sequentially fixedly connected by the fixing bolts.

9. The pump housing structure of a three-axis multi-stage Roots pump according to claim 1, wherein the first-stage pump housing (1) and the third-stage pump housing (3) are fixedly mounted with mounting bases (44) at the bottom thereof.

* * * * *